US009487900B2

(12) United States Patent
Noh et al.

(10) Patent No.: US 9,487,900 B2
(45) Date of Patent: Nov. 8, 2016

(54) WASHING MACHINE

(75) Inventors: Hyunwoo Noh, Kyungsangnam-do (KR); Taehee Lee, Kyungsangnam-do (KR); Youngjong Kim, Kyungsangnam-do (KR)

(73) Assignee: LG ELECTRONICS INC., Seoul (KR)

( * ) Notice: Subject to any disclaimer, the term of this patent is extended or adjusted under 35 U.S.C. 154(b) by 1201 days.

(21) Appl. No.: 13/256,164

(22) PCT Filed: Mar. 16, 2010

(86) PCT No.: PCT/KR2010/001623
§ 371 (c)(1),
(2), (4) Date: Nov. 23, 2011

(87) PCT Pub. No.: WO2010/107231
PCT Pub. Date: Sep. 23, 2010

(65) Prior Publication Data

US 2012/0056517 A1 Mar. 8, 2012

(30) Foreign Application Priority Data

Mar. 20, 2009 (KR) ..... 10-2009-0024104
Mar. 20, 2009 (KR) ..... 10-2009-0024105

(51) Int. Cl.
*D06F 37/24* (2006.01)
*D06F 37/20* (2006.01)

(52) U.S. Cl.
CPC ..... *D06F 37/24* (2013.01); *D06F 37/20* (2013.01)

(58) Field of Classification Search
CPC ..... D06F 37/24
See application file for complete search history.

(56) References Cited

U.S. PATENT DOCUMENTS 1,911,294 A * 5/1933 Stramaglia ..... 210/364

FOREIGN PATENT DOCUMENTS

| | | | | | |
|---|---|---|---|---|---|
| JP | 62-50582 | U | | 3/1987 | |
| JP | 62050582 | | * | 3/1987 | |
| JP | 2008-178653 | A | * | 8/1998 | ..... D06F 37/24 |
| KR | 10-1990-0017100 | U | | 10/1990 | |
| KR | 20-1998-0064615 | U | | 11/1998 | |
| KR | 1998-064615 | | * | 11/1998 | ..... D06F 37/20 |
| KR | 10-1996-0014476 | | * | 9/1999 | |
| KR | 10-0220130 | B1 | * | 9/1999 | ..... D06F 37/24 |
| KR | 10-0220130 | B1 | | 9/1999 | |
| KR | 10-2003-0055968 | A | * | 12/2001 | ..... D06F 37/26 |
| KR | 10-2003-0055968 | A | | 7/2003 | |
| KR | 10-2007-0046451 | A | | 5/2007 | |
| KR | 2007-0046451 | | * | 5/2007 | |

OTHER PUBLICATIONS

English machine translation of (KR10-1996-0014476).*

* cited by examiner

*Primary Examiner* — Michael Barr
*Assistant Examiner* — Jason Riggleman
(74) *Attorney, Agent, or Firm* — Birch, Stewart, Kolasch & Birch, LLP

(57) ABSTRACT

A washing machine according to the present invention comprises: a vibration limiter disposed on an outer cistern, wherein the vibration limiter is capable of decreasing vibration by absorbing kinetic energy of a suspension when the outer cistern is excessively vibrating. Thus, the present invention prevents collision between a cabinet and the outer cistern which can be generated when the outer cistern is excessively vibrating, thereby achieving the effect of preventing damage to the surrounding parts. Furthermore, since collision between the outer cistern and the cabinet is prevented, it is possible to minimize space between the outer cistern and the cabinet, which allows the enlargement of outer cistern capacity.

8 Claims, 11 Drawing Sheets

WASHING MACHINE

TECHNICAL FIELD

The present invention relates to a laundry machine, and, more particularly, to a laundry machine wherein an outer tub is prevented from becoming excessively vibrated, thereby preventing collision between the outer tub and a cabinet and increasing the volume of the outer tub.

BACKGROUND ART

Generally, a laundry machine may be classified as a washing machine that removes contaminants from clothes, bedclothes and the like (hereinafter, referred to as "laundry") using water, detergent and mechanical action, a drying machine that dries wet laundry using hot dry air heated by a heater and mechanical action, or a washing and drying machine that washes and dries laundry.

A washing machine may be classified as a top load type washing machine configured so that a laundry introduction hole, through which laundry is introduced or removed, is formed at the top of a cabinet, and washing is performed by circulation of water generated during rotation of an inner tub or a drum type washing machine configured so that a laundry introduction hole is formed at the front of a cabinet, and washing is performed by tumbling of laundry generated during rotation of an inner tub.

A conventional top load type washing machine includes an outer tub to contain wash water, an inner tub disposed in the outer tub to wash laundry placed therein, and a motor disposed below the outer tub to rotate the inner tub. The outer tub is disposed in the cabinet in a state in which the outer tub is suspended by a suspension. The upper end of the suspension is connected to the upper part of the cabinet at the inside of the cabinet, and the lower end of the suspension is connected to the lower part of the outer tub. The suspension serves to absorb vibration generated from the outer tub and to support the outer tub.

In the conventional top load type washing machine, however, the outer tub occasionally collides with the inside of the cabinet when the outer tub is excessively vibrated. Such collision results in damage to the outer tub, the cabinet, the motor and the like.

In recent years, the volume of a washing machine has been increased with the result that the size of the outer tub has been gradually increased. For this reason, the distance between the outer tub and the cabinet has been gradually decreased with the result that the outer tub frequently collides with the inside of the cabinet.

DISCLOSURE

Technical Problem

It is an object of the present invention to provide a laundry machine wherein collision between an outer tub and a cabinet is prevented, whereby reliability of the laundry machine is improved and the volume of the outer tub is increased.

Technical Solution

In accordance with one aspect of the present invention, the above and other objects can be accomplished by the provision of a laundry machine including a cabinet having a laundry introduction hole, through which laundry is introduced and removed, formed at the top thereof, an outer tub disposed in the cabinet to contain wash water, a suspension connected between the cabinet and the outer tub so that the outer tub is suspended from the cabinet, and a vibration limiter disposed at the outer tub so that at least a portion of the suspension is inserted through the vibration limiter in a surrounded fashion to limit a range in which the insertion portion of the suspension is moved, thereby damping vibration.

The vibration limiter may limit vibration of the suspension in the direction facing the outer tub and/or in the direction parallel to the circumference of the outer tub.

The vibration limiter may be formed in the shape of a polyhedron and may have an insertion hole, through which the suspension is inserted.

The vibration limiter may be open at one side thereof so that the suspension is inserted in the lateral direction.

The vibration limiter may be provided at the open side thereof with catching protrusions to prevent the suspension from escaping from the vibration limiter.

The insertion hole may have a sectional area gradually increased toward the upper side thereof.

The insertion hole may have a sectional area greater than that of the suspension so that the suspension is moved in the insertion hole within a predetermined range.

The vibration limiter may have a ring-shaped section to surround a circumference of the suspension.

In accordance with another aspect of the present invention, there is provided a laundry machine including a cabinet having a laundry introduction hole, through which laundry is introduced and removed, formed at the top thereof, an outer tub disposed in the cabinet to contain wash water, a suspension connected between the cabinet and the outer tub so that the outer tub is suspended from the cabinet, and a vibration limiter disposed at the outer tub and/or the suspension to absorb kinetic energy of the suspension or the outer tub, when the outer tub and the suspension come into contact with each other, thereby limiting vibration.

The vibration limiter may be mounted at the outer tub so that the vibration limiter comes into surface contact with the suspension.

The vibration limiter may be formed in the shape of a polyhedron, the side of which facing the suspension is inclined vertically and rounded horizontally.

The vibration limiter may be formed in the shape of a band, opposite ends of which are fixed to the outer tub and at least a portion of which is spaced a predetermined distance from the outer tub.

Effects of the Invention

In the laundry machine according to the present invention, the vibration limiter is disposed at the outer tub so that the suspension is inserted through the vibration limiter in a surrounded fashion. When the outer tub is excessively vibrated, the vibration limiter absorbs the kinetic energy of the suspension, while limiting a range in which the suspension is moved, to damp vibration. Consequently, the present invention has the effect of preventing collision between the cabinet and the outer tub which may be caused when the outer tub is excessively vibrated. In addition, it is possible to prevent damage to peripheral parts which may caused by the collision between the cabinet and the outer tub.

Also, it is possible to minimize the distance between the outer tub and the cabinet, thereby increasing the volume of the outer tub.

Also, the vibration limiter is configured to surround the left and right sides of the suspension as well as the front and rear sides of the suspension. Consequently, it is possible for the vibration limiter to absorb vibration generated from the suspension in all directions including the frontward-and-rearward direction and the left-and-right direction.

BEST MODEL

Now, a top load type washing machine (hereinafter, referred to as a 'washing machine'), as an example of a laundry machine according to the present invention, will be described in detail with reference to the accompanying drawings.

Figure 1:
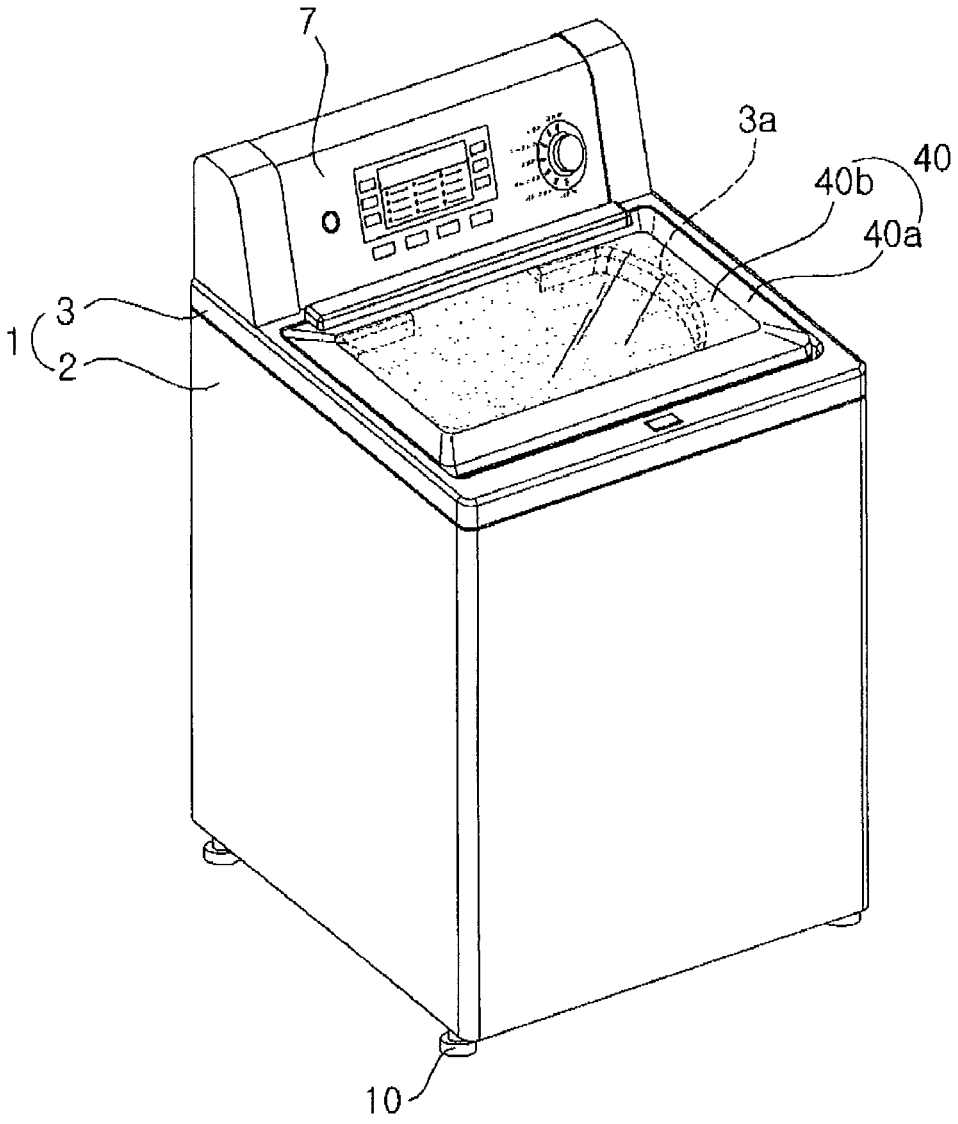
FIG. 1 is a perspective view showing a top load type washing machine according to a first embodiment of the present invention.
Figure 2:
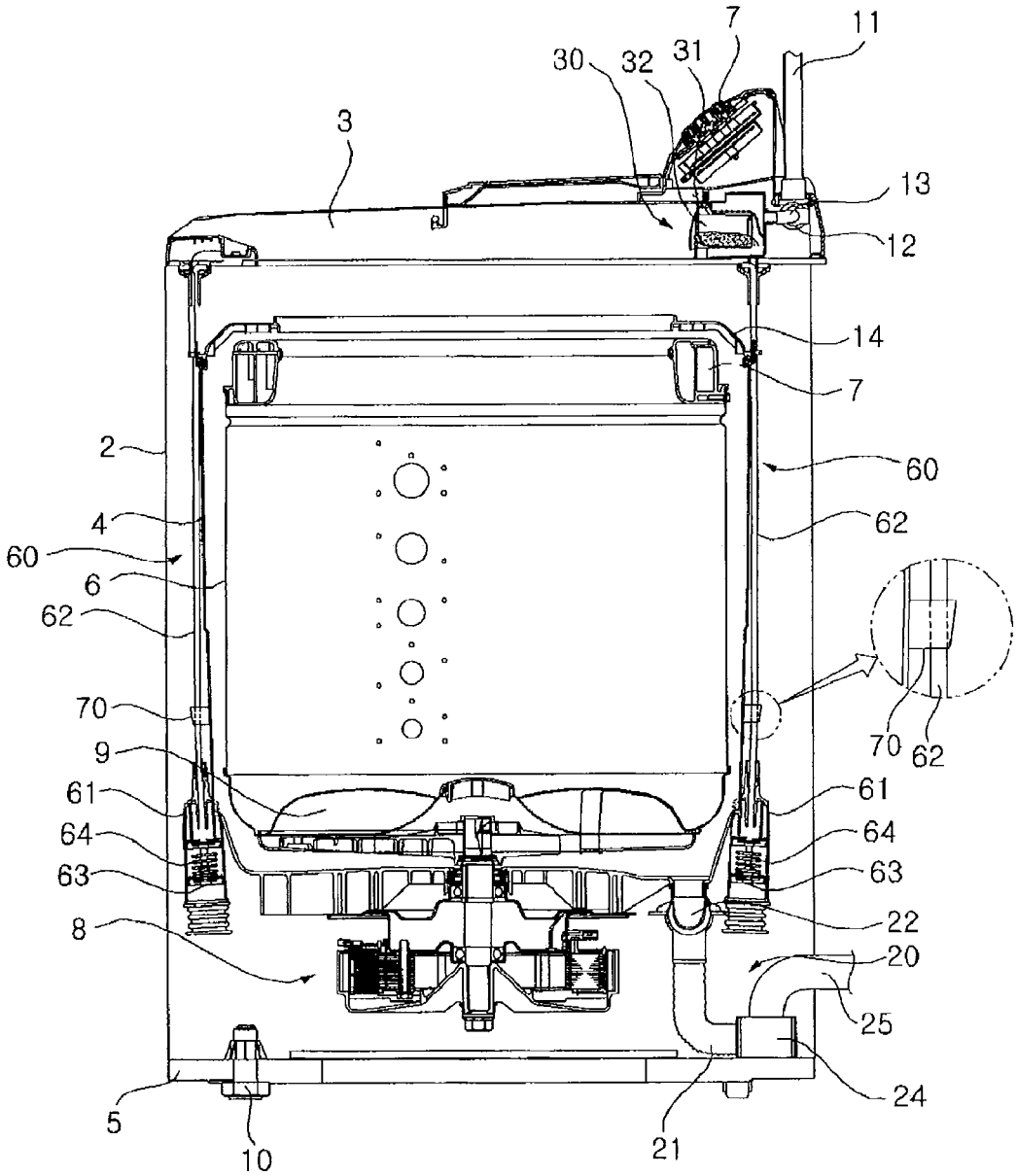
FIG. 2 is a vertical sectional view of the washing machine shown in FIG. 1.

FIG. 1 is a perspective view showing a top load type washing machine according to a first embodiment of the present invention, and FIG. 2 is a vertical sectional view of the washing machine shown in FIG. 1.

Referring to FIGS. 1 and 2, the washing machine according to the first embodiment of the present invention includes a case 1 forming the outer appearance of the washing machine and a leg assembly 10 coupled to the bottom of the case 1.

The case 1 includes a cabinet 2 open at the top and bottom thereof to form the side of the washing machine, a top cover 3 disposed to cover the open top of the cabinet 2, and a base 5 mounted at the open bottom of the cabinet 2.

In the cabinet 2 are disposed an outer tub 4 to contain wash water, an inner tub 6 disposed in the outer tub 4 to contain laundry, a drive device 8, such as a motor, to drive the inner tub 6, a water supply assembly to supply wash water into the outer tub 4, a drainage assembly 20 to drain wash water from the outer tub 4 upon completion of washing or spin-drying, and a detergent supply unit 30 connected to the water supply assembly to supply detergent upon the supply of wash water.

In the top cover 3 is formed a laundry introduction hole 3*a* through which laundry is introduced or removed. At the top cover 3 is mounted a door 400 to open and close the laundry introduction hole 3*a*. At least a portion of the door 40 may be formed of glass, through which the interior of the washing machine is viewable. That is, the door 40 includes a frame part 40*a* and a glass part 40*b* fitted in the frame part 40*a*.

At one side of the top cover 3 is mounted a control panel 7 to input the operation of the washing machine and to display the operation state of the washing machine.

At the bottom of the inner tub 6 is mounted a pulsator 9 to agitate wash water contained in the outer tub 4.

At the upper side of the inner tub 6 is mounted a balancer 15 to prevent the inner tub 6 from becoming unbalanced due to non-uniform distribution of laundry.

A hydraulic balancer having liquid contained therein may be used as the balancer 15.

The outer tub 4 is disposed in the cabinet 2 so that the outer tub 4 is suspended from the inner upper part of the cabinet 2 via a suspension 60.

At the upper side of the outer tub 4 is mounted an outer tub cover 14 to prevent the escape of laundry or the overflow of wash water from the outer tub 4.

The water supply assembly includes an external hose 11 to guide wash water, supplied through an external faucet, into the washing machine, a water supply valve 12 connected to the external hose 11 to allow or stop the supply of wash water therethrough, and a water supply hose 13 connected between the water supply valve 12 and the detergent supply unit 30. The water supply valve 12 and the water supply hose 13 form a water supply channel through which wash water is supplied.

The detergent supply unit 30 is disposed on the water supply channel. The detergent supply unit 30 includes a detergent box housing 31 disposed so as to communicate with the water supply hose 13, a detergent box 32 detachably mounted in the detergent box housing 31, and a detergent box cover fixed to the detergent box housing 31 and disposed at the top of the detergent box 32 to spray wash water.

The detergent box 32 is coupled to the detergent box housing 31 in such a manner that the detergent box 32 can be drawn out of the detergent box housing 31 so that a user can fill the detergent box 32 with detergent. The detergent box 32 may be coupled to the detergent box housing 31 so that the detergent box 32 can slide in the frontward-and-rearward direction. The rear of the detergent box 32 is at least partially open so that, during the supply of wash water, detergent can be introduced into the detergent box housing 31 through the rear of the detergent box 32 together with the wash water.

The drainage assembly 20 is disposed between the outer tub 4 and the base 5. The drainage assembly 20 includes a first drainage hose 21 connected to the bottom of the outer tub 4, a drainage valve 22 mounted on the first drainage hose 21 to allow or stop the drainage of wash water therethrough, a drainage pump housing 24 including a drainage pump 23 to pump wash water, and a second drainage hose 25 connected to the drainage pump housing 24 to drain the wash water pumped by the drainage pump 23 out of the cabinet 2.

In the drainage pump housing 24 is mounted a drainage motor to drive the drainage pump 23.

Figure 3:
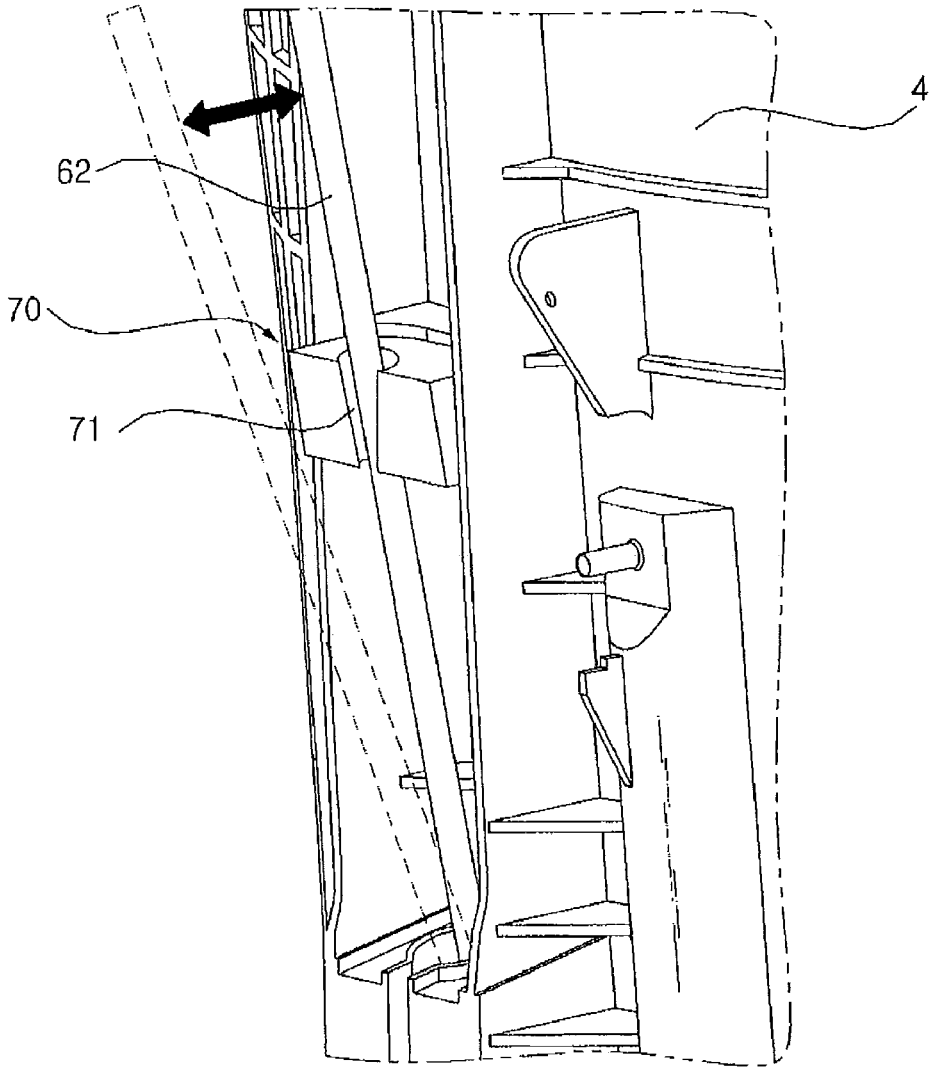
FIG. 3 is a perspective view showing a portion of an outer tub at which a vibration limiter according to an embodiment of the present invention is mounted.
Figure 4:
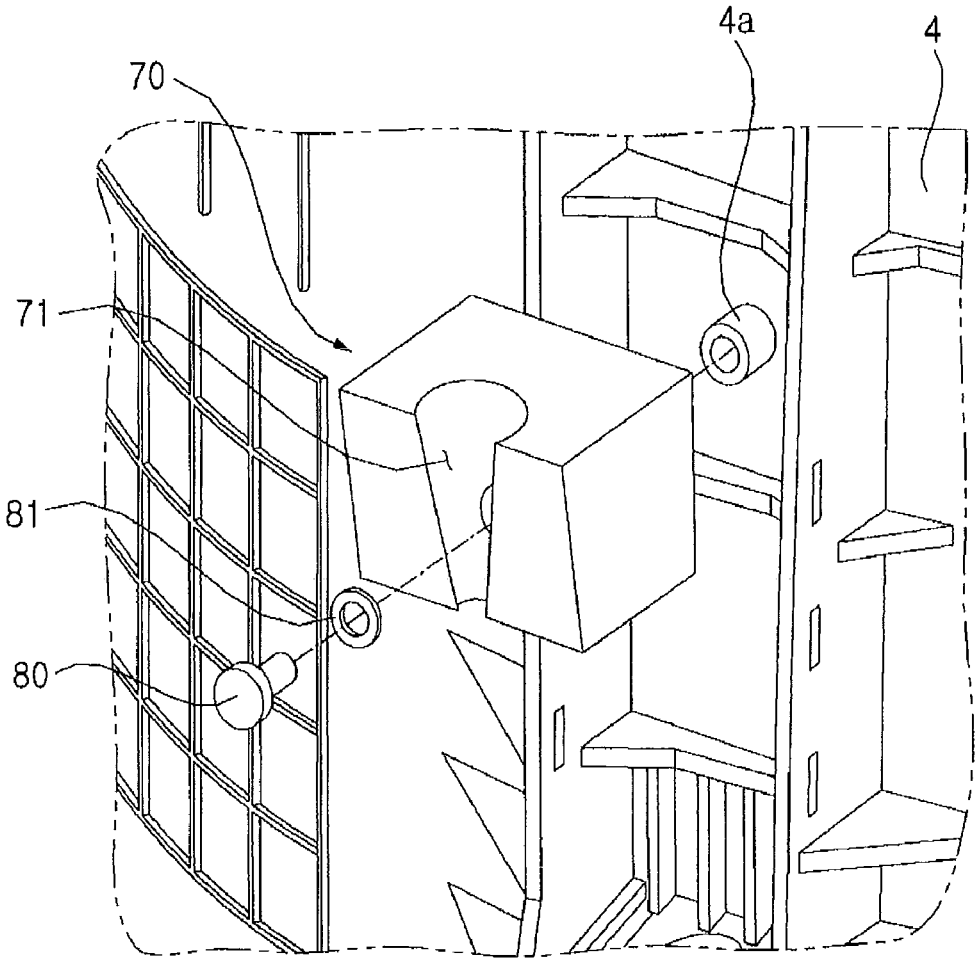
FIG. 4 is an exploded perspective view of the vibration limiter shown in FIG. 3.
Figure 5:
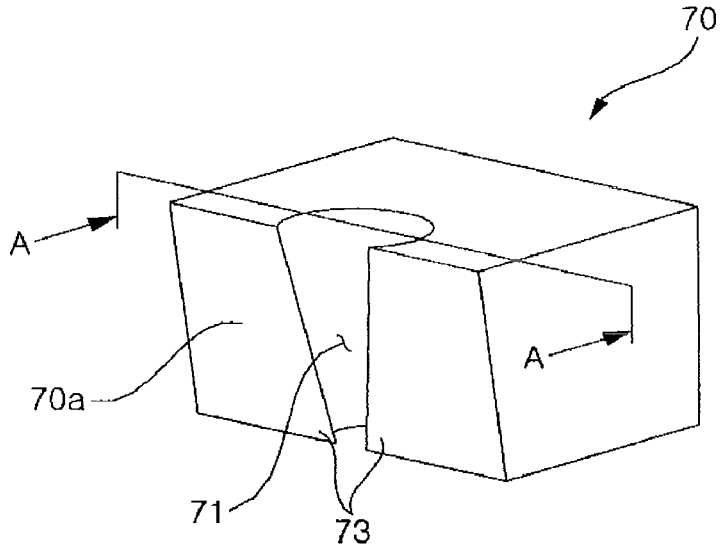
FIG. 5 is an enlarged perspective view of the vibration limiter shown in FIG. 4.
Figure 6:
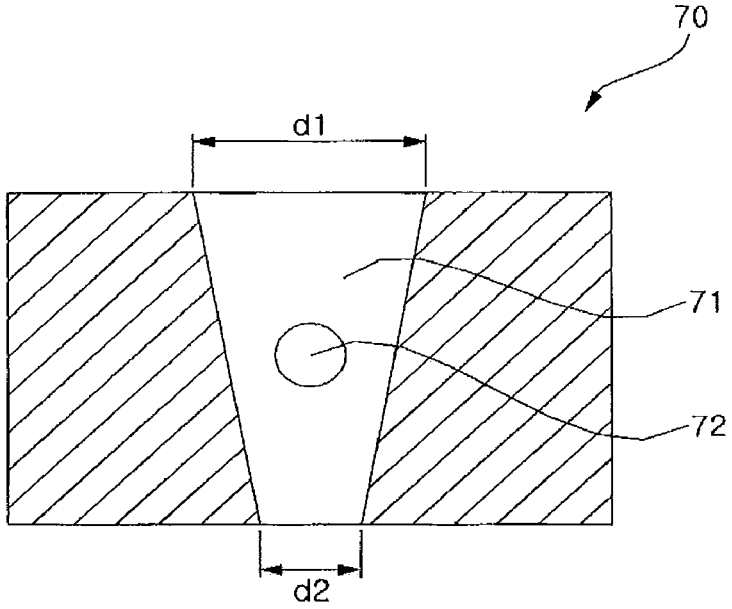
FIG. 6 is a sectional view taken along line A-A of FIG. 5.

FIG. 3 is a perspective view showing a portion of an outer tub at which a vibration limiter according to an embodiment of the present invention is mounted, FIG. 4 is an exploded perspective view of the vibration limiter shown in FIG. 3, FIG. 5 is an enlarged perspective view of the vibration limiter shown in FIG. 4, and FIG. 6 is a sectional view taken along line A-A of FIG. 5.

Referring to FIGS. 3 to 5, the laundry machine according to the present invention further includes a vibration limiter 70 disposed in the outer tub 4, so that at least a portion of the suspension 60 is inserted through the vibration limiter 70, to limit vibration of the suspension 60 while surrounding the inserted portion of the suspension 60.

The vibration limiter 70 is mounted at the outer circumference of the outer tub 4 toward the suspension 60. Preferably, the vibration limiter 70 is mounted at the outer circumference of the outer tub 4 at the lower part of the outer tub 4.

The vibration limiter 70 may be formed in the shape of a polyhedron.

The vibration limiter 70 may be made of an elastic material, such as rubber, to provide elastic force to the suspension 60 when the suspension 60 is vibrated.

The vibration limiter 70 is provided with an insertion hole 71, through which the suspension 60 is inserted.

The insertion hole 71 is formed at a front part 70*a* of the vibration limiter 70 facing the suspension 60.

Referring to FIG. 2, the suspension 60 includes a suspension cap 61 supported at the lower part of the outer tub 4, a suspension bar 62 having an upper end supported at the cabinet 2 and a lower end extending through the suspension cap 61, a suspension base 62 disposed at the lower end of the suspension bar 62 so that the suspension base 62 can be in airtight contact with the inner circumference of the suspension cap 61, and a compression spring 64 disposed between the suspension cap 61 and the suspension base 63.

Referring to FIGS. 2 and 3, the suspension bar 62 is inserted through the insertion hole 71.

The front part of the insertion hole 71 is open so that the suspension bar 62 can be inserted in the lateral direction, i.e. toward the outer tub 4.

Also, the insertion hole 71 is vertically open so that the suspension bar 62 can extend through the insertion hole in the vertical direction.

When the suspension 60 and the vibration limiter collide with each other as the result of the vibration of the suspension 60, the suspension 60 comes into surface contact with the vibration limiter 70. When the suspension 60 comes into surface contact with the vibration limiter 70 as the result of the vibration of the suspension 60, a phenomenon in which the suspension 60 is dislocated is prevented. Also, when the suspension comes into surface contact with the vibration limiter, contact time is longer than when the suspension comes into line contact with the vibration limiter, thereby improving damping force.

The suspension bar 62 is formed in the shape of a cylinder. Consequently, the inner circumference of the insertion hole 71 is curved so as to correspond to the outer circumference of the suspension bar 62.

Also, the suspension bar 62 is disposed at a predetermined angle to the outer tub 4. Consequently, the front part 70*a* of the vibration limiter 70 is also inclined downward so as to correspond to the inclined suspension bar 62.

Also, referring to FIG. 6, the sectional area of the insertion hole 71 is gradually increased toward the upper side of the insertion hole 71. That is, an upper end diameter d1 of the insertion hole 71 is less than a lower end diameter d2 of the insertion hole 71.

Also, the sectional area of the insertion hole 71 is greater than that of the suspension bar 62. The sectional area of the insertion hole 71 varies in the vertical direction. For this reason, the smallest section area of the insertion hole is greater than that of the suspension bar 62.

Although the suspension 60 remains inserted through the insertion hole 71 of the vibration limiter 70, therefore, the suspension 60 comes into contact with the inner circumference of the insertion hole 71 of the vibration limiter 70 only when the suspension 60 is excessively vibrated but the suspension 60 does not come into contact with the inner circumference of the insertion hole 71 at normal times. That is, the suspension bar 62 comes into contact with the inner circumference of the insertion hole 71 only when the suspension bar 62 is vibrated a predetermined distance or more.

At the open front part of the insertion hole 71 are formed catching protrusions 73 to prevent escape of the suspension 60 from the insertion hole 71. The width of the open front part of the insertion hole 71 is less than the diameter of the suspension bar 62 due to the catching protrusions 73.

Meanwhile, the vibration limiter 70 may be fastened to the outer tub 4 by a fastening member, such as a bolt 80 or may be bonded to the outer tub 4 by a bonding member (not shown). In this embodiment, the vibration limiter 70 is fastened to the outer tub 4 by the bolt 80.

At the inside of the insertion hole 71 is formed a through hole 72, through which the bolt 80 extends.

At the outer tub 4 is formed a fastening boss 4*a* to which the bolt 80, extending through the through hole 72, is fastened. The diameter of the through hole 72 is greater than that of the fastening boss 4*a*. The fastening boss 4*a* may be inserted into the through hole 72.

A washer 81 is disposed between the bolt 80 and the fastening boss 4*a*.

The length of the bolt 80 is less than the frontward-and-rearward depth of the through hole 72 so that the bolt 80 cannot protrude out of the insertion hole 71.

In this embodiment, four suspensions 60 are arranged at predetermined intervals to balance the outer tub 4.

Also, four vibration limiters 70 are provided so as to correspond to the suspensions 60.

Hereinafter, the operation of the vibration limiter with the above-stated construction according to the first embodiment of the present invention will be described.

Figure 7:
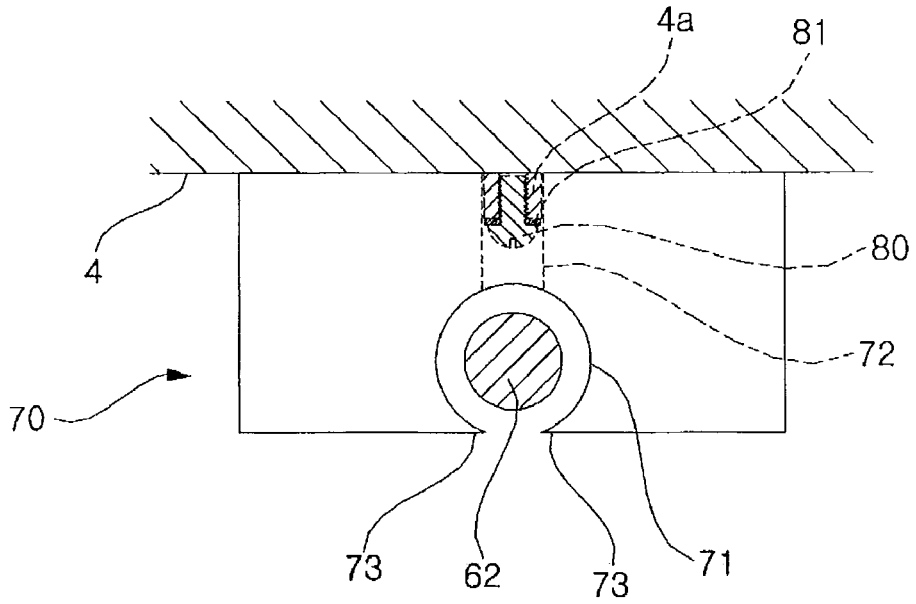
FIG. 7 is a plan view showing the vibration limiter according to the embodiment of the present invention and a suspension bar.
Figure 8:
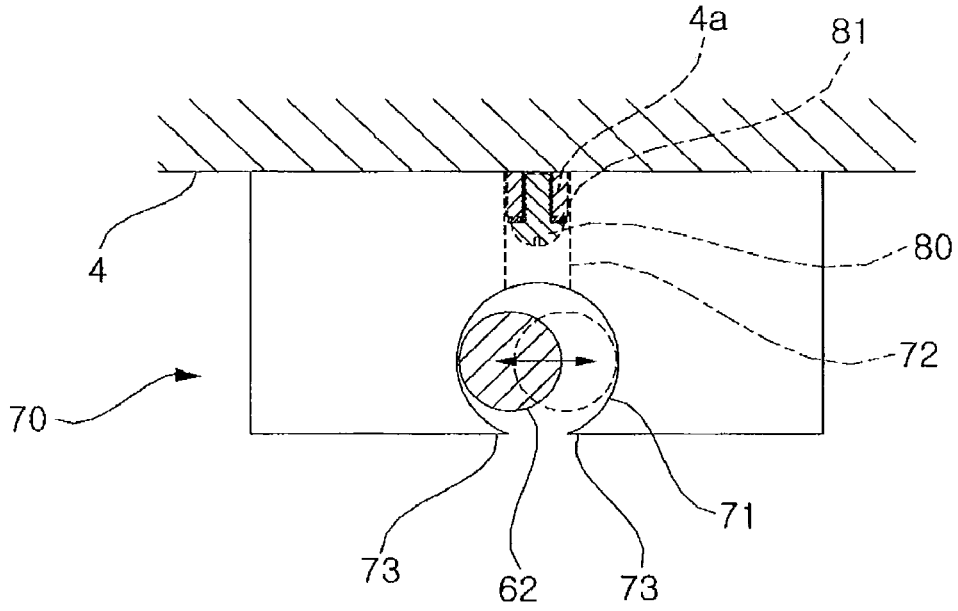
FIG. 8 is a plan view showing a state in which the suspension bar is vibrated in the left-and-right direction in FIG. 7.
Figure 9:
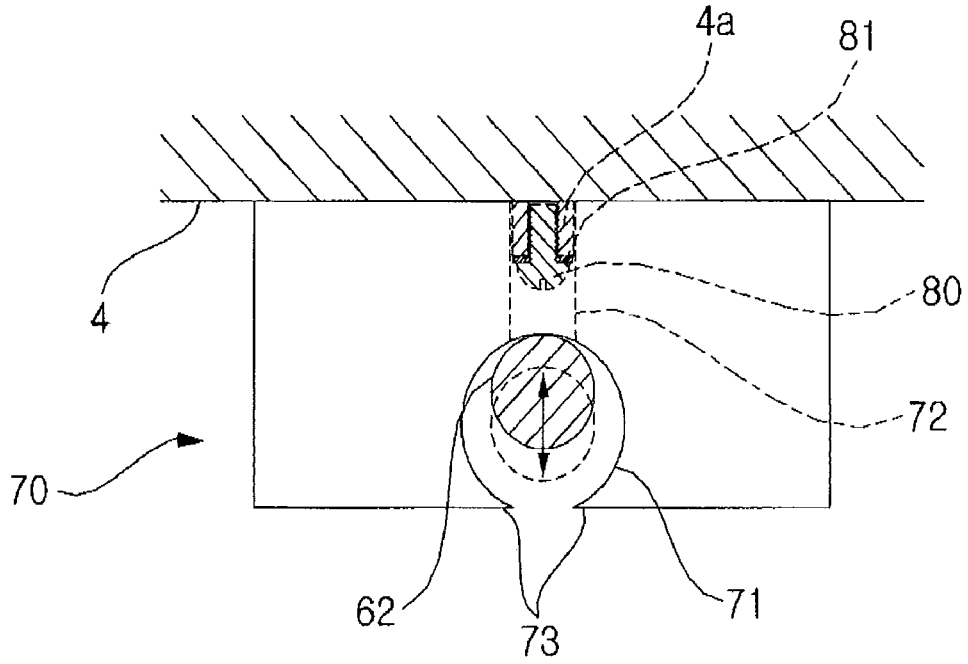
FIG. 9 is a plan view showing a state in which the suspension bar is vibrated in the frontward-and-rearward direction in FIG. 7.

FIG. 7 is a plan view showing the vibration limiter according to the first embodiment of the present invention and the suspension bar, FIG. 8 is a plan view showing a state in which the suspension bar is vibrated in the left-and-right direction in FIG. 7, and FIG. 9 is a plan view showing a state in which the suspension bar is vibrated in the frontward-and-rearward direction in FIG. 7.

Referring to FIG. 7, the suspension bar 62, inserted through the insertion hole 71 of the vibration limiter 70, does not come into contact with the inner circumference of the insertion hole 71 when vibration is not generated from the outer tub 4 or when vibration generated from the outer tub 4 is small.

When the outer tub 4 is normally vibrated, the vibration generated from the outer tub 4 is transmitted to the suspension 60, and the compression spring 64 in the suspension cap 61 is compressed or extended to absorb the vibration.

When the outer tub 4 is excessively vibrated, on the other hand, the outer tub 4 is translated toward the cabinet 2 in the radial direction.

When the outer tub 4 is translated toward the cabinet 2 in the radial direction, the suspension 60 may also be vibrated.

Referring to FIGS. 8 and 9, when the outer tub 4 is excessively vibrated, the suspension bar 62 is vibrated in the insertion hole 71 in the circumferential direction of the outer tub 4 (hereinafter, referred to as a 'left-and-right direction' about the suspension bar 62) or in the direction perpendicular to the circumference of the outer tub 4 (hereinafter, referred to as a 'frontward-and-rearward direction' about the suspension bar 62). The suspension bar 62 comes into contact with the inner circumference of the insertion hole 71 while the suspension bar 62 is vibrated in the left-and-right direction and in the frontward-and-rearward direction.

When the suspension bar 62 comes into contact with the insertion hole 71, the vibration limiter 70 provides elastic force to absorb the kinetic energy of the suspension 60.

Consequently, the kinetic energy of the suspension 60 is extinguished to limit excessive vibration of the suspension 60.

Referring to FIG. 8, when the suspension bar 62 is vibrated in the left-and-right direction, the suspension bar 62 comes into contact with the left and right sides of the inner circumference of the insertion hole 71 with the result that the kinetic energy of the suspension bar 62 is extinguished.

Referring to FIG. 9, when the suspension bar 62 is vibrated in the frontward-and-rearward direction, the suspension bar 62 comes into contact with the front and rear sides of the inner circumference of the insertion hole 71 with the result that the kinetic energy of the suspension bar 62 is extinguished. At this time, the suspension bar 62 is prevented from escaping from the vibration limiter 70 by the catching protrusions 73.

As described above, it is possible for the vibration limiter 70 to hold the suspension bar 62 when the suspension bar 62 is vibrated in the left-and-right direction as well as when the suspension bar 62 is vibrated in the frontward-and-rearward direction.

Since the suspension 60 comes into surface contact with the vibration limiter 70, the suspension is prevented from becoming dislocated when the suspension 60 comes into contact with the vibration limiter 70. Also, when the suspension comes into surface contact with the vibration limiter, contact time is longer than when the suspension comes into line contact with the vibration limiter, thereby more effectively absorbing kinetic energy.

That is, when the outer tub 4 is excessively vibrated, the suspension 60 is also excessively moved. Since the kinetic energy of the suspension 60 is absorbed by the vibration limiter 70, the excessive movement of the suspension 60 is limited. As the excessive movement of the suspension 60 is limited, it is possible for the suspension 60 to effectively support the outer tub 4, thereby preventing the outer tub 4 from becoming excessively vibrated and thus preventing collision between the outer tub 4 and the cabinet 2.

Since the collision between the outer tub 4 and the cabinet 2 is effectively prevented, it is possible to reduce the distance between the outer tub 4 and the cabinet 2 in a design stage, thereby increasing the size of the outer tub 2 and thus increasing the washing volume of the washing machine.

Figure 10:
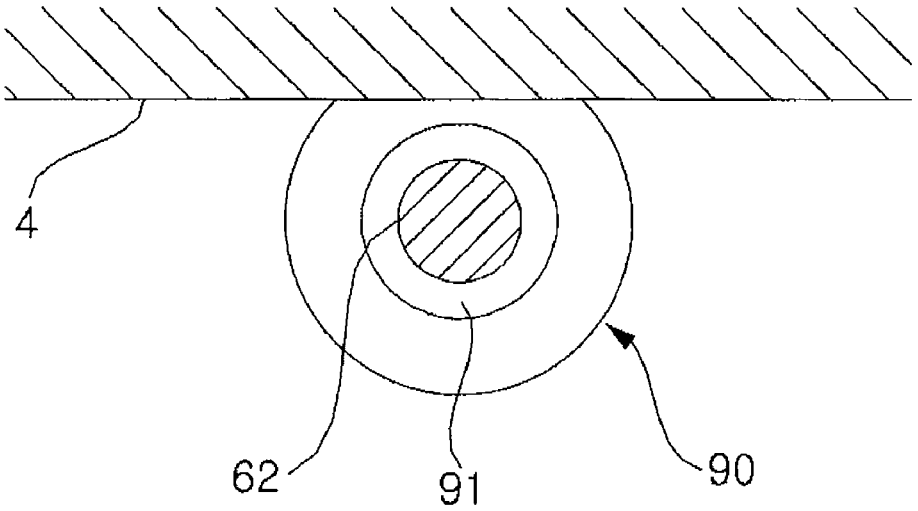
FIG. 10 is a plan view showing a vibration limiter according to a second embodiment of the present invention.

FIG. 10 is a plan view showing a vibration limiter according to a second embodiment of the present invention.

Referring to FIG. 10, the vibration limiter 90 according to the second embodiment of the present invention is identical or similar in construction and operation to the vibration limiter according to the previous embodiment of the present invention except that the vibration limiter 90 is formed in the shape of a ring to surround the overall circumference of the suspension bar 62 of the suspension 60, and therefore, a description of the identical or similar parts of the vibration limiter according to the second embodiment of the present invention will be omitted.

That is, the vibration limiter 90 is provided with an insertion hole 91, through which the suspension bar 62 is inserted in the vertical direction. The insertion hole 91 is open only in the vertical direction. Consequently, the section of the vibration limiter 90 forms a closed surface.

The vibration limiter 90 may be formed so as to correspond to the outer circumferential shape of the outer tub 4 so that the side of the vibration limiter 90 facing the outer tub 4 can come into tight contact with the outer tub 4.

The vibration limiter 90 may be fixed to the outer tub 4 by an additional clamping member or may be bonded to the outer tub 4 by a bonding agent.

Figure 11:
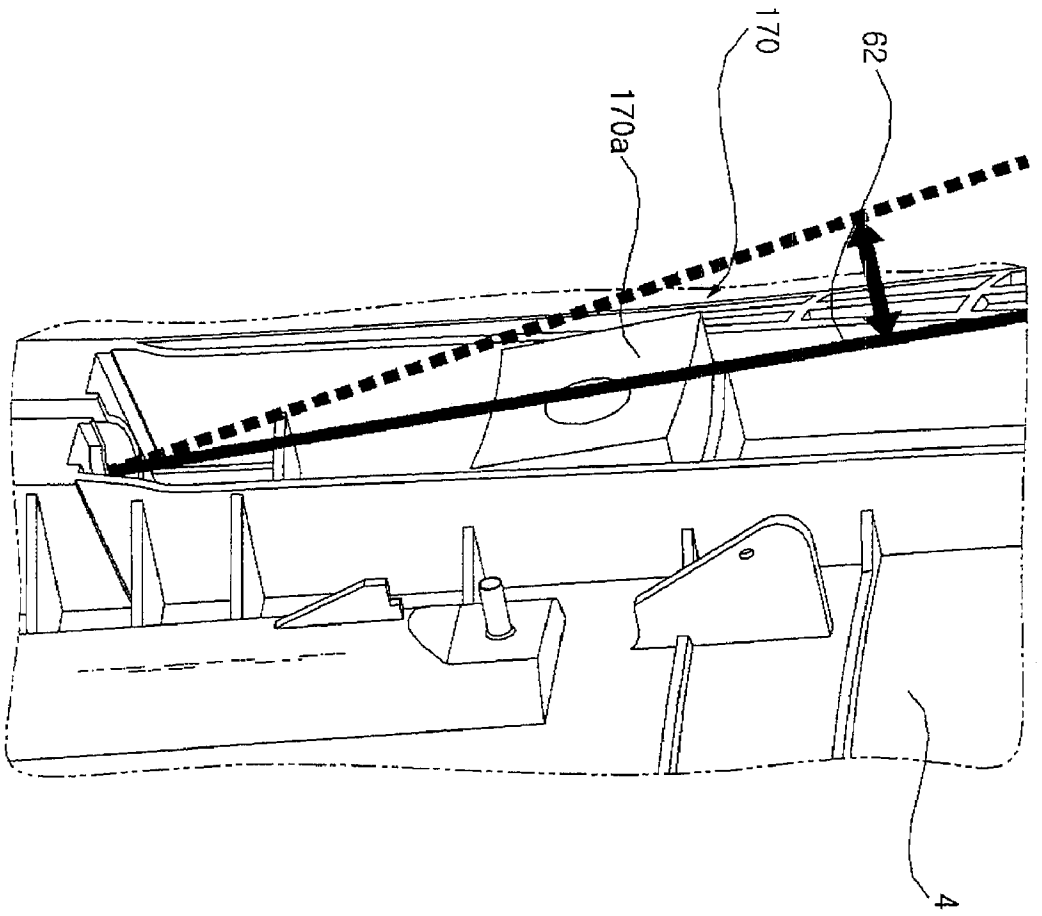
FIG. 11 is a perspective view showing a portion of an outer tub at which a vibration limiter according to a third embodiment of the present invention is mounted.
Figure 12:
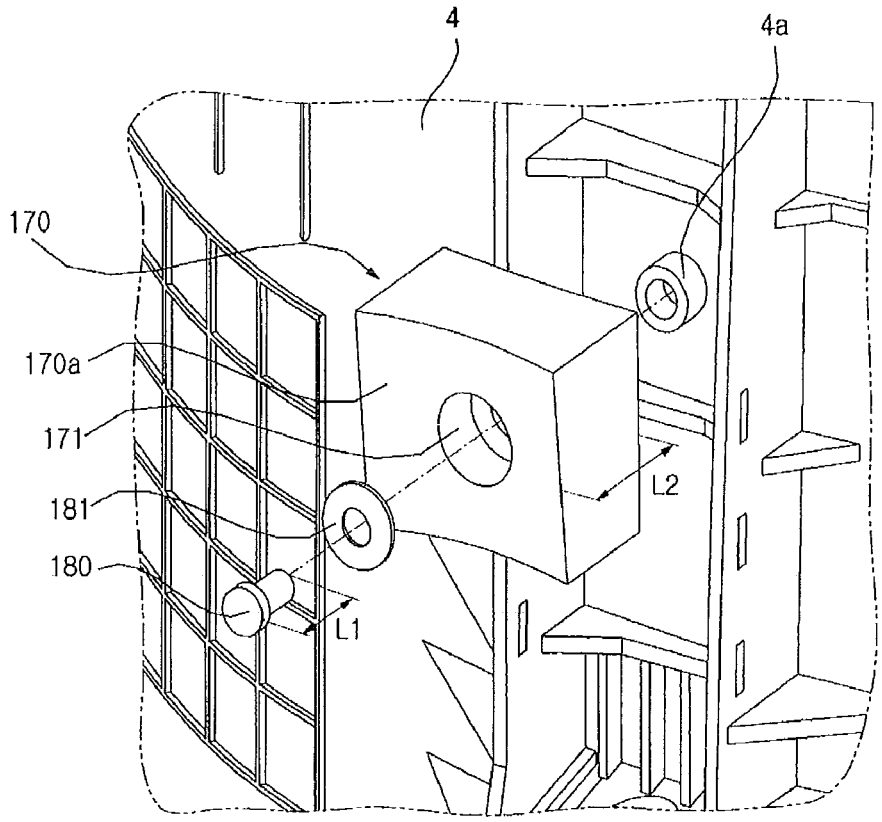
FIG. 12 is an exploded perspective view of the vibration limiter shown in FIG. 11.
Figure 13:
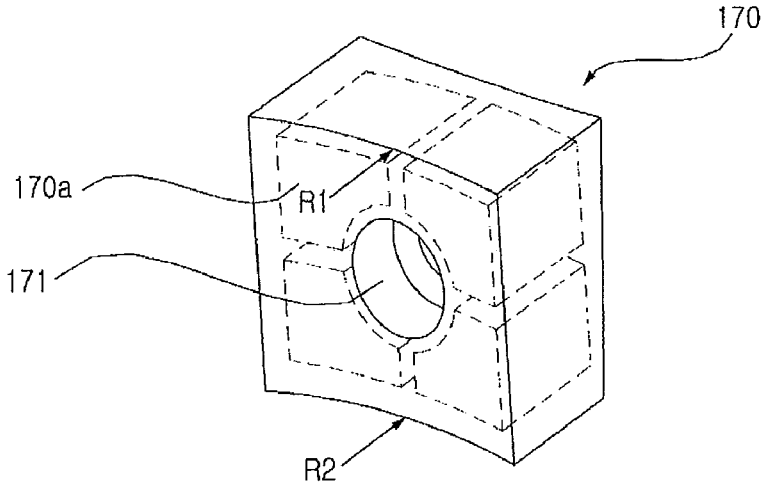
FIG. 13 is an enlarged perspective view of the vibration limiter shown in FIG. 12.

FIG. 11 is a perspective view showing a portion of an outer tub at which a vibration limiter according to a third embodiment of the present invention is mounted, FIG. 12 is an exploded perspective view of the vibration limiter shown in FIG. 11, and FIG. 13 is an enlarged perspective view of the vibration limiter shown in FIG. 12.

Referring to FIGS. 11 to 13, the laundry machine according to the third embodiment of the present invention includes a vibration limiter 170 disposed at the outer tub 4 and/or the suspension 60 to absorb kinetic energy of the suspension 60 and/or the outer tub 4, thereby limiting the vibration of the suspension 60. The construction of the washing machine except the vibration limiter 170 is identical to that of the washing machine according to the first embodiment of the present invention. Consequently, the same parts of the washing machine are denoted by the same reference numerals, and a detailed description thereof will be omitted.

The vibration limiter 170 may be mounted at the outer circumference of the outer tub 4 or may be mounted at the side of the suspension 60 facing the outer tub 4. In addition, vibration limiters 170 may be mounted at the outer tub 4 and the suspension 60, respectively.

In this embodiment, the vibration limiter 170 is mounted at the outer circumference of the outer tub 4.

The suspension 60 is disposed outside the vibration limiter 170. The vibration limiter 170 is mounted at the outer circumference of the outer tub 4 at the lower part of the outer tub 4 so that the vibration limiter 170 is opposite to the suspension 60.

The vibration limiter 170 may be formed in the shape of a polyhedron. In this embodiment, the vibration limiter 170 is formed in the shape of a hexahedron, to which, however, the present invention is not limited. Of course, therefore, the vibration limiter 170 may be formed in different shapes except the hexahedron.

At the vibration limiter 170 is formed a through hole 171, through which a fastening member, such as a bolt 180, extends. The through hole 171 may be formed at the center of the vibration limiter 170.

At the outer tub 4 is formed a fastening boss **104*a* to which the bolt 180, extending through the through hole 171, is fastened. The diameter of the through hole 171 is greater than that of the fastening boss 104*a*. The fastening boss 104*a* may be inserted into the through hole 171**.

A washer 181 is disposed between the bolt 180 and the fastening boss **104*a***.

Referring to FIG. 12, a length L1 of the bolt 180 is less than a frontward-and-rearward depth L2 of the through hole 171 so that the bolt 180 cannot protrude out of the vibration limiter 170.

The vibration limiter 170 may be made of an elastic material, such as rubber, to provide elastic force to the suspension 60 when the suspension 60 is vibrated.

When the vibration limiter 70 and the suspension collide with each other, the suspension 60 comes into surface contact with the vibration limiter 170. When the suspension 60 comes into surface contact with the vibration limiter 170 as the result of the vibration of the suspension 60, a phenomenon in which the suspension 60 is dislocated is prevented. Also, when the suspension comes into surface contact with the vibration limiter, contact time is longer than when the suspension comes into line contact with the vibration limiter, thereby improving damping force.

When the suspension 60 is vibrated, the suspension bar 62 comes into contact with the vibration limiter 170. The suspension bar 62 is formed in the shape of a cylinder.

Consequently, a front part 170*a* of the vibration limiter 170 opposite to the suspension bar 62 is rounded so that the suspension bar 62 can come into surface contact with the vibration limiter 170.

Also, the suspension 60 is disposed at a predetermined angle to the outer tub 4. Consequently, the front part 170*a* of the vibration limiter 170 opposite to the suspension bar 62 is also inclined downward.

Referring to FIG. 13, the front part 170*a* of the vibration limiter 170 is rounded and inclined at the predetermined angle. Consequently, the curvature of the front part 170*a* of the vibration limiter 170 opposite to the suspension bar 62 is gradually decreased toward the lower side of the front part 170*a* of the vibration limiter 170.

That is, referring to FIG. 13, a curvature R2 at the lower end of the front part 170*a* of the vibration limiter 170 is less than a curvature R1 at the upper end of the front part 170*a* of the vibration limiter 170.

In this embodiment, four suspensions 60 are arranged at predetermined intervals to balance the outer tub 4.

Also, four vibration limiters 170 are provided so as to correspond to the suspensions 60.

Hereinafter, the operation of the vibration limiter with the above-stated construction according to the third embodiment of the present invention will be described.

During operation of the washing machine, vibration is generated from the outer tub 4 by the rotation of the motor 8.

The vibration generated from the outer tub 4 is transmitted to the suspension 60, and the compression spring 64 in the suspension cap 61 is compressed or extended to absorb the vibration.

Meanwhile, when the outer tub 4 is excessively vibrated, the outer tub 4 is translated toward the cabinet 2 in the radial direction.

When the outer tub 4 is translated in the radial direction, the suspension 60 may also be vibrated.

As the outer tub 4 and the suspension 60 are vibrated, the outer tub 4 and the suspension 60 come close to each other.

At this time, the vibration limiter 170 comes into contact with the suspension 60 to absorb the kinetic energy of the suspension 60.

Consequently, the kinetic energy of the suspension 60 is extinguished, and therefore, excessive vibration of the suspension 60 is limited.

Also, the vibration limiter 170 pushes the suspension 60, while providing elastic force to the suspension 60, to assist the suspension 60 to return to the original position thereof.

Since the suspension 60 comes into surface contact with the vibration limiter 170, the suspension 60 is prevented from becoming dislocated during contact between the suspension 60 and the vibration limiter 170. Also, when the suspension comes into surface contact with the vibration limiter, contact time is longer than when the suspension comes into line contact with the vibration limiter, and therefore, it is possible to more effectively absorb the kinetic energy of the suspension.

That is, when the outer tub 4 is excessively vibrated, the suspension 60 is also excessively moved. At this time, the kinetic energy of the suspension 60 is absorbed by the vibration limiter 170, and therefore, the excessive movement of the suspension 60 is limited. As the excessive movement of the suspension 60 is limited, the outer tub 4 is effectively supported by the suspension 60. Consequently, the excessive vibration of the outer tub 4 is also prevented, and therefore, it is possible to prevent a phenomenon in which the outer tub 4 collides with the cabinet 2.

Since the collision between the outer tub 4 and the cabinet 2 is effectively prevented, it is possible to reduce the distance between the outer tub 4 and the cabinet 2 in a design stage, thereby increasing the size of the outer tub 2 and thus increasing the washing volume of the washing machine.

Figure 14:
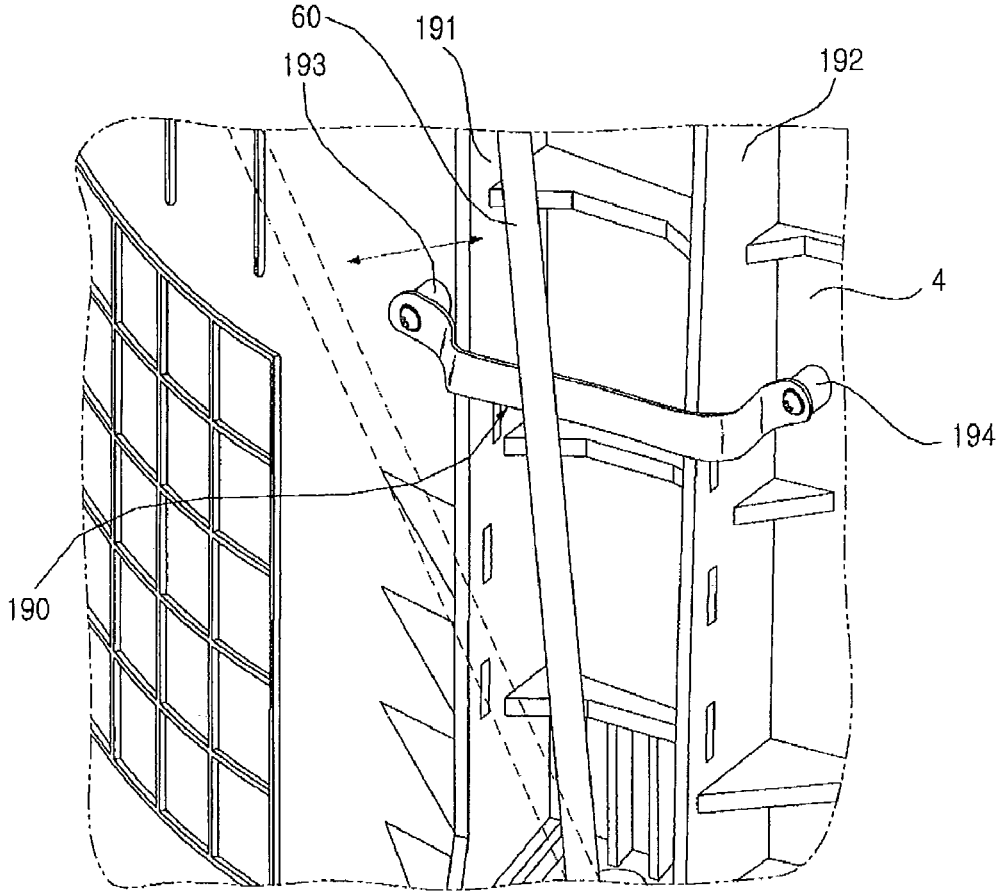
FIG. 14 is a perspective view showing a portion of an outer tub at which a vibration limiter according to a fourth embodiment of the present invention is mounted.
Figure 15:
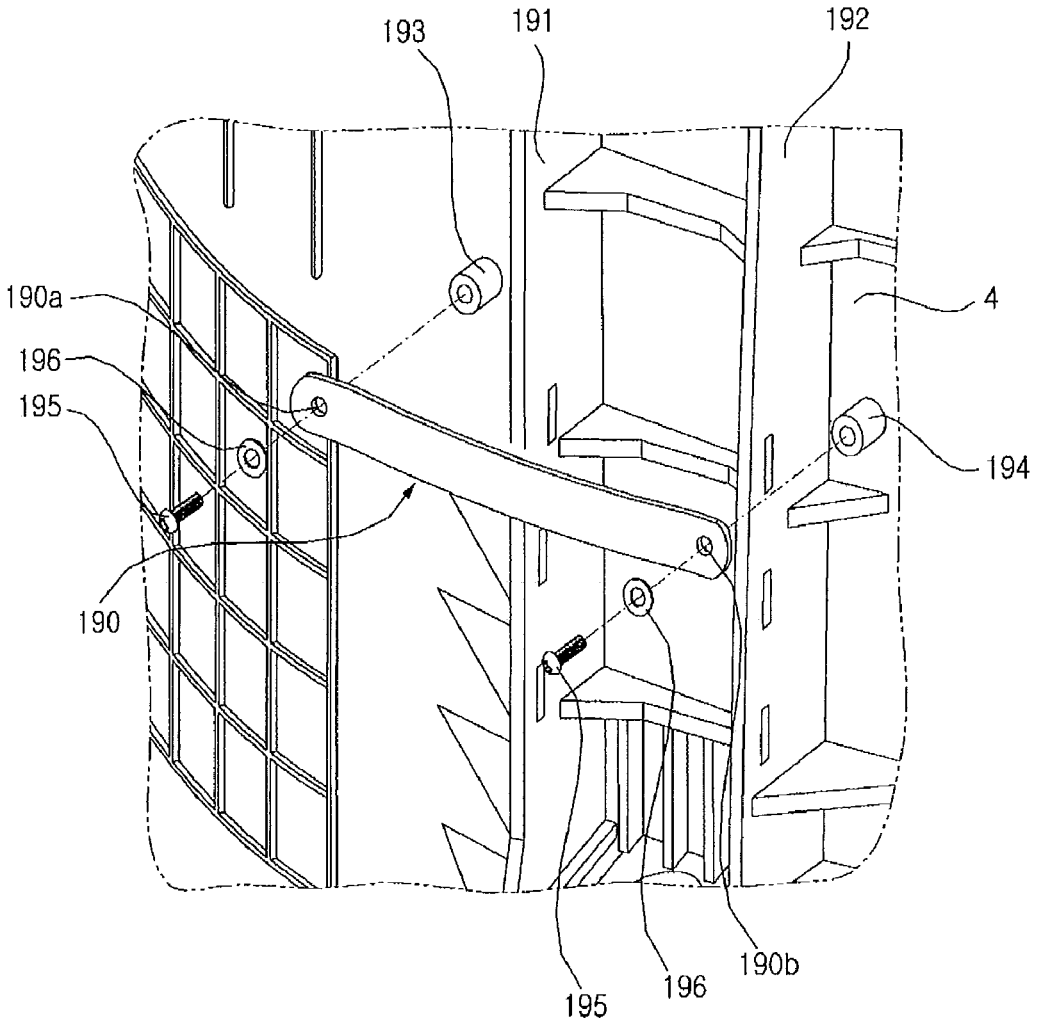
FIG. 15 is an exploded perspective view of the vibration limiter shown in FIG. 14.

FIG. 14 is a perspective view showing a portion of an outer tub at which a vibration limiter according to a fourth embodiment of the present invention is mounted, and FIG. 15 is an exploded perspective view of the vibration limiter shown in FIG. 14.

Referring to FIGS. 14 and 15, the vibration limiter 190 according to the fourth embodiment of the present invention is identical or similar in construction and operation to the vibration limiter according to the third embodiment of the present invention except that the vibration limiter 190 is formed in the shape of a band spaced a predetermined distance from the outer tub 4, and therefore, a description of the identical or similar parts of the vibration limiter according to the fourth embodiment of the present invention will be omitted.

The vibration limiter 190 may be formed of an elastic band having a small thickness and a large horizontal length.

A pair of first and second ribs 191 and 192, extending vertically and spaced a predetermined distance from each other, is formed at the circumference of the outer tub 4 in a protruding fashion.

The vibration limiter 190 is disposed in front of the first and second ribs 191 and 192. Opposite ends of the vibration limiter 190 are fastened to fastening bosses 193 and 194 protruding from the outer tub 4.

The fastening bosses include a first fastening boss 193 disposed at the left side of the first rib 191 and a second fastening boss 194 disposed at the right side of the second rib 192. The opposite ends of the vibration limiter 190 are fastened to the first fastening boss 193 and the second fastening boss 194 by fastening members, such as bolts 195. First and second fastening holes 190*a* and 190*b* are formed at the opposite ends of the vibration limiter 190, respectively. Washers 196 may be disposed respectively between the first and second fastening holes 190*a* and 190*b* and the corresponding bolts 195.

The opposite ends of the vibration limiter 190 are fixed to the first and second fastening bosses 193 and 194. The middle portion of the vibration limiter 190 is placed over the first and second ribs 191 and 192.

The first and second ribs 191 and 192 serve to push the middle portion of the vibration limiter 190 outward, and therefore, the vibration limiter 190 is pulled outward tensely. Also, at least a portion of the vibration limiter 190 is spaced a predetermined distance from the circumference of the outer tub 4 by the first and second ribs 191 and 192. When the outer tub 4 is excessively vibrated, therefore, the suspension 60 is also vibrated. As a result, the suspension 60 comes into contact with the vibration limiter 190.

As the suspension 60 comes into contact with the vibration limiter 190, the vibration limiter 190 provides elastic force to the suspension 60 to absorb the kinetic energy of the suspension 60.

Consequently, the kinetic energy of the suspension 60 is extinguished, and therefore, excessive vibration of the suspension 60 is limited.

Also, the vibration limiter 190 pushes the suspension 60, while providing elastic force to the suspension 60, to assist the suspension 60 to return to the original position thereof.

In the aforementioned embodiments, the vibration limiter is mounted at the outer circumference of the outer tub, to which, however, the present invention is not limited. For example, the vibration limiter may be disposed at the side of the suspension facing the outer tub.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A laundry machine comprising:

a cabinet having a laundry introduction hole, through which laundry is introduced and removed, formed at a top thereof;

an outer tub disposed in the cabinet to contain wash water;

a suspension connected between the cabinet and the outer tub so that the outer tub is suspended from the cabinet; and a vibration limiter disposed at the outer tub so that at least an insertion portion of the suspension is inserted through the vibration limiter in a surrounded fashion to limit a range in which the insertion portion of the suspension is moved, thereby damping vibration, wherein the suspension includes:

a suspension cap supported at the lower part of the outer tub; and a suspension bar having an upper end supported at the cabinet and a lower end extending through the suspension cap, wherein the vibration limiter has an insertion hole, through which the suspension bar is inserted, wherein a cross sectional area of the insertion hole gradually increases toward an upper side of the insertion hole, wherein the vibration limiter is fastened to the outer tub by a fastening member, and further comprising a through hole formed inside of the insertion hole through which the fastening member extends.

2. The laundry machine according to claim 1, wherein the vibration limiter limits vibration of the suspension in a direction facing the outer tub and/or in a direction parallel to a circumference of the outer tub.

3. The laundry machine according to claim 1, wherein a length of the fastening member is less than a frontward-and-rearward depth of the through hole.

4. The laundry machine according to claim 1, wherein an upper end of the suspension bar is connected to an upper part of the cabinet positioned above the outer tub.

5. The laundry machine according to claim 4, wherein the vibration limiter is open at one side thereof so that the suspension bar is inserted in a lateral direction.

6. The laundry machine according to claim 5, wherein the vibration limiter is provided at the open side thereof with catching protrusions to prevent the suspension bar from escaping from the vibration limiter.

7. The laundry machine according to claim 6, wherein a smallest cross sectional area of the insertion hole is greater than a cross sectional area of the suspension bar so that the suspension bar is moved in the insertion hole within a predetermined range.

8. The laundry machine according to claim 7, wherein the vibration limiter has a ring-shaped section to surround a circumference of the suspension.

* * * * *